US008391499B1

(12) United States Patent
Snyder

(10) Patent No.: US 8,391,499 B1
(45) Date of Patent: Mar. 5, 2013

(54) METHOD AND APPARATUS FOR ENHANCING AUDITORY SPATIAL PERCEPTION

(76) Inventor: Ross Daniel Snyder, Austin, TX (US)

( * ) Notice: Subject to any disclaimer, the term of this patent is extended or adjusted under 35 U.S.C. 154(b) by 0 days.

(21) Appl. No.: 13/296,255

(22) Filed: Nov. 15, 2011

Related U.S. Application Data

(63) Continuation of application No. 12/217,477, filed on Jul. 3, 2008, now Pat. No. 8,059,823.

(51) Int. Cl.
*H04R 5/00* (2006.01)

(52) U.S. Cl. ..... 381/1; 381/56

(58) Field of Classification Search ..... 381/1–10, 381/56–67
See application file for complete search history.

(56) References Cited

U.S. PATENT DOCUMENTS

| | | | | |
|---|---|---|---|---|
| 4,551,825 | A | 11/1985 | Biber | |
| 4,680,740 | A | 7/1987 | Treplow | |
| 5,107,467 | A | 4/1992 | Jorgensen et al. | |
| 5,239,515 | A | 8/1993 | Borenstein et al. | |
| 5,724,313 | A | 3/1998 | Burgess et al. | |
| 6,011,754 | A | 1/2000 | Burgess et al. | |
| 6,201,470 | B1 | 3/2001 | Withington | |
| 6,469,956 | B1 | 10/2002 | Zeng | |
| 6,671,226 | B1 | 12/2003 | Finkel et al. | |
| 7,054,226 | B1 | 5/2006 | Hickling | |
| 7,577,263 | B2 * | 8/2009 | Tourwe | 381/56 |
| 7,706,548 | B2 | 4/2010 | Kanevsky et al. | |
| 8,059,823 | B1 | 11/2011 | Snyder | |
| 8,150,043 | B2 * | 4/2012 | Goldstein et al. | 381/56 |
| 8,265,291 | B2 * | 9/2012 | Bridger et al. | 381/67 |

* cited by examiner

*Primary Examiner* — Cuong Q Nguyen

(57) ABSTRACT

In accordance with at least one embodiment, a method and apparatus is provided for generating a first pressure wave propagating in a first direction, said first pressure wave adapted to interact with at least a first portion of a plurality of environmental objects and to produce a first response audible to a user, for generating a second pressure wave propagating in a second direction, said second pressure wave adapted to interact with at least a second portion of the plurality of environmental objects and to produce a second response audible to the user; and for causing additional iterations of the first and second pressure waves. In accordance with at least one embodiment, the first pressure wave is initiated with a first abrupt increase in amplitude and the second pressure wave is initiated with a second abrupt increase in amplitude.

20 Claims, 4 Drawing Sheets

METHOD AND APPARATUS FOR ENHANCING AUDITORY SPATIAL PERCEPTION

CROSS-REFERENCE TO RELATED APPLICATIONS

The present application claims priority to the non-provisional application entitled "METHOD AND APPARATUS FOR ENHANCING AUDITORY SPATIAL PERCEPTION," filed Jul. 3, 2008, assigned application Ser. No. 12/217,477, and issued on Nov. 15, 2011, as U.S. Pat. No. 8,059,823, which claims priority to the provisional application entitled "METHOD AND APPARATUS FOR ENHANCING AUDITORY SPATIAL PERCEPTION," filed Jul. 5, 2007, and assigned Application No. 60/958,369.

BACKGROUND OF THE INVENTION (1) Field of the Invention

At least one embodiment of the present invention relates generally to acoustics and, more particularly, to a method and apparatus for enhancing psychoacoustic awareness of surroundings using plural directional sources.

(2) Description of the Related Art

Many people rely upon vision to provide spatial perception. However, others have diminished vision or no vision, which can impair such spatial perception. Such diminished vision or lack of vision can be of physiological and/or anatomical origin or may result from environmental phenomena (such as, for example, darkness, smoke, fog, chemicals, etc.). Impaired spatial perception can impair awareness of one's surroundings, which can impair mobility and performance of tasks.

Impairment or lack of vision can lead to more reliance on other sensory inputs, for example, hearing. External structures of the ear and the binaural inputs provided by two ears can facilitate spatial perception of sounds sources. However, many objects in one's surroundings may not normally emit audible sounds. Moreover, the characteristics of any sounds emitted by surrounding objects may be unknown and/or psychoacoustically confusing. Thus, a technique for generating a reliable excitation having familiar characteristics is needed to enhance psychoacoustic awareness of surroundings.

BRIEF DESCRIPTION OF THE SEVERAL VIEWS OF THE DRAWINGS

The present invention may be better understood, and its features made apparent to those skilled in the art by referencing the accompanying drawings.

The use of the same reference symbols in different drawings indicates similar or identical items.

DETAILED DESCRIPTION OF THE INVENTION

In accordance with at least one embodiment, a method and apparatus is provided for generating a first pressure wave propagating in a first direction, said first pressure wave adapted to interact with at least a first portion of a plurality of environmental objects and to produce a first response audible to a user, for generating a second pressure wave propagating in a second direction, said second pressure wave adapted to interact with at least a second portion of the plurality of environmental objects and to produce a second response audible to the user; and for causing additional iterations of the first and second pressure waves. In accordance with at least one embodiment, the first pressure wave is initiated with a first abrupt increase in amplitude and the second pressure wave is initiated with a second abrupt increase in amplitude.

Figure 1:
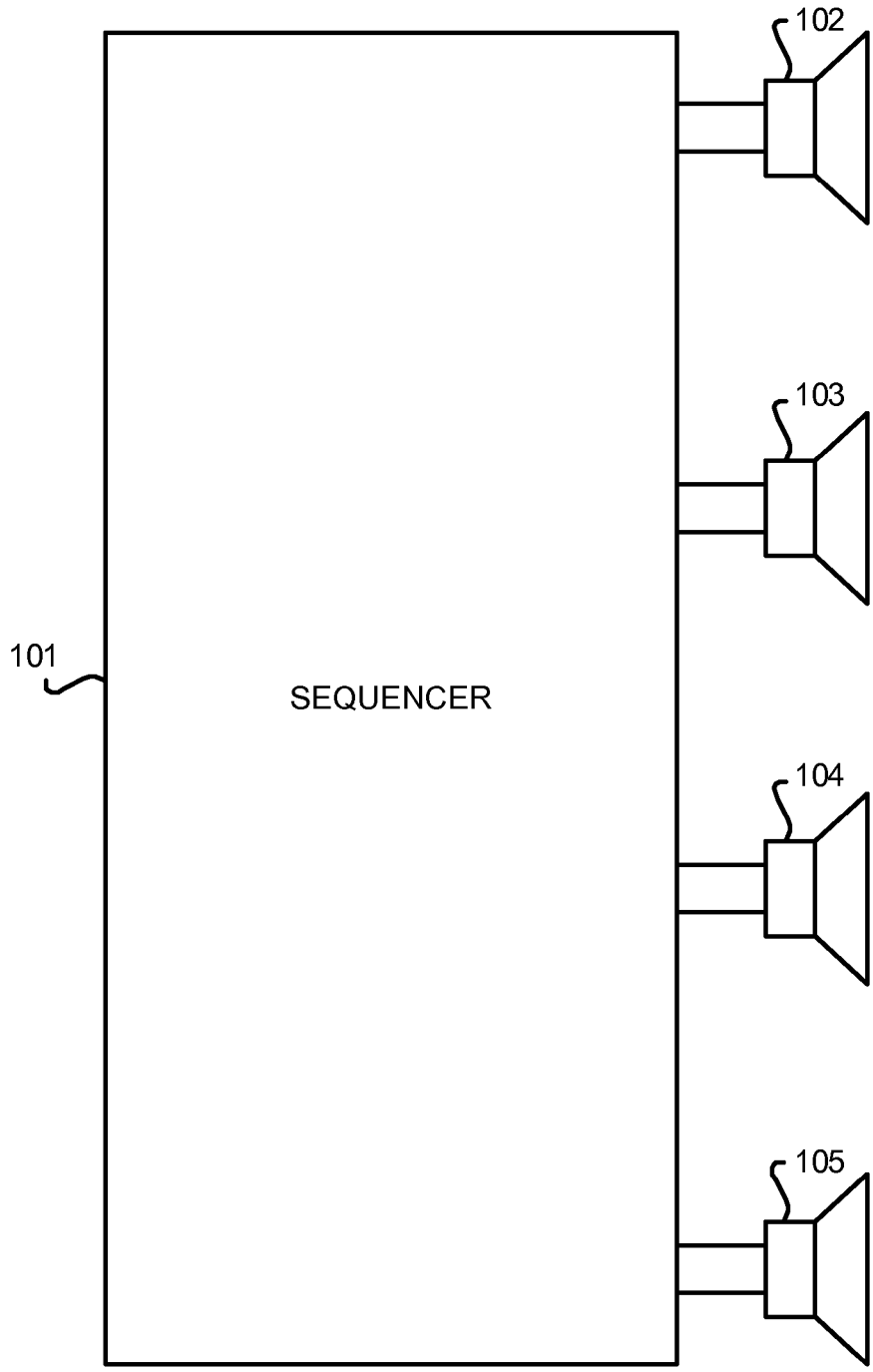
FIG. 1 is a block diagram illustrating at least one embodiment of apparatus for enhancing spatial perception.

FIG. 1 is a block diagram illustrating at least one embodiment of apparatus for enhancing spatial perception. The apparatus comprises sequencer 101 and a plurality of transducers 102, 103, 104, and 105 coupled to sequencer 101. Transducers capable of responding rapidly to an excitation pulse may be used. For example, piezoelectric tweeters, dynamic speakers, electrostatic speakers, piezoelectric buzzers, spark gap transducers, and/or other types of piezoelectric, electromechanical, electrostatic, electrochemical and/or electrophysical transducers may be used. The number of transducers may be varied according to the desired psychoacoustic effects and/or according to space and/or budgetary constraints.

Figure 2:
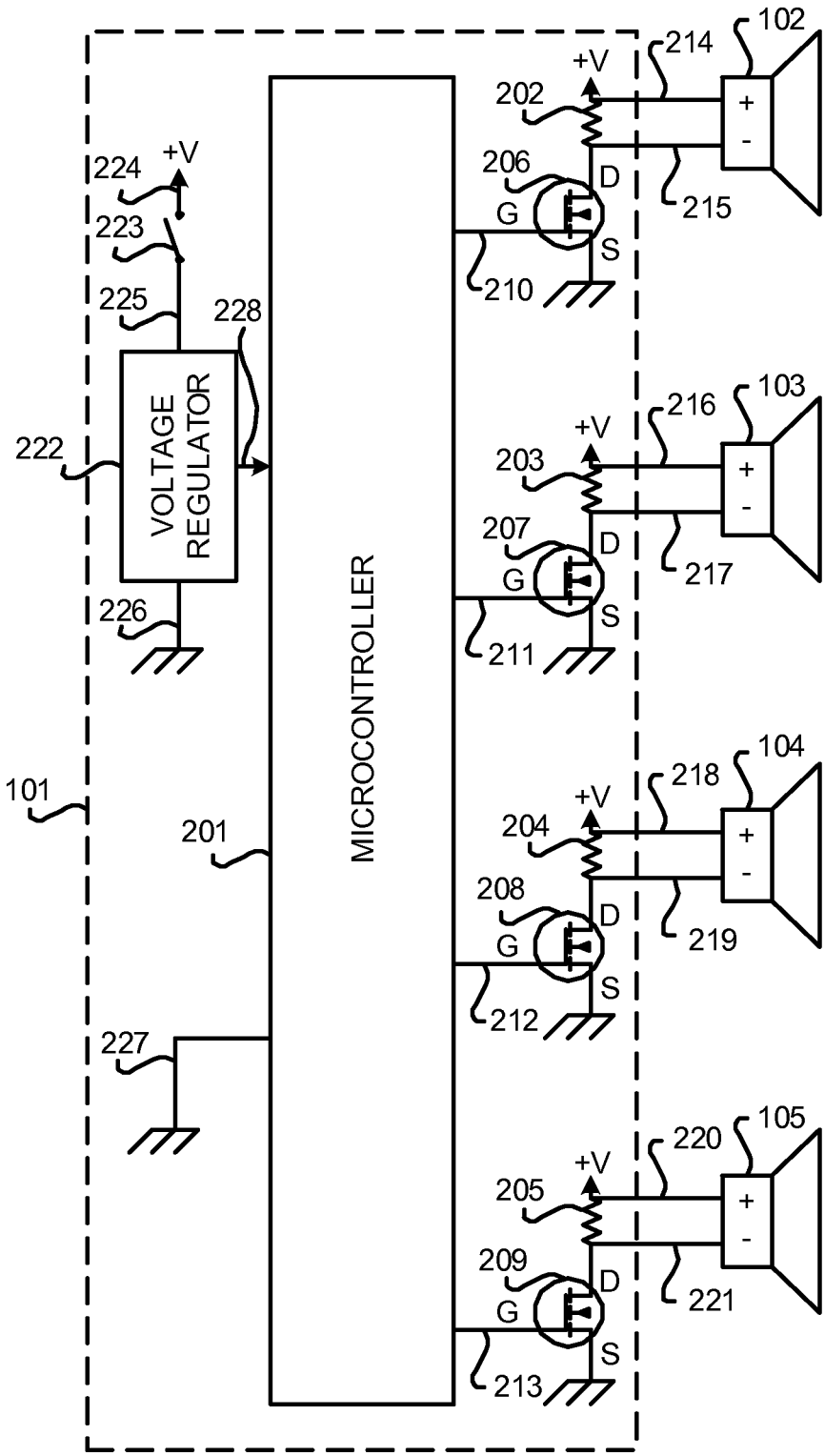
FIG. 2 is a schematic diagram illustrating at least one embodiment of apparatus for enhancing spatial perception.

FIG. 2 is a schematic diagram illustrating at least one embodiment of apparatus for enhancing spatial perception. The apparatus comprises sequencer 101 and a plurality of transducers 102, 103, 104, and 105 coupled to sequencer 101. Sequencer 101 comprises microcontroller 201 and driver circuitry comprising metal-oxide-semiconductor field-effect transistors (MOSFETs) 206, 207, 208, and 209 coupled to microcontroller 201 via their gate terminals. A first output 210 of microcontroller 201 is coupled to the gate terminal of MOSFET 206. A second output 211 of microcontroller 201 is coupled to the gate terminal of MOSFET 207. A third output 212 of microcontroller 201 is coupled to the gate terminal of MOSFET 208. A fourth output 213 of microcontroller 201 is coupled to the gate terminal of MOSFET 209.

The source terminals of MOSFETs 206, 207, 208, and 209 are coupled to a negative supply voltage, referred to as VSS and denoted by a chassis ground symbol. A positive supply voltage, referred to as VDD and denoted by a +V symbol, is coupled to a positive terminal 214 of transducer 102, a positive terminal 216 of transducer 103, a positive terminal 218 of transducer 104, and a positive terminal 220 of transducer 105, as well as a to first terminal of each of resistors 202, 203, 204, and 205. The negative terminal 215 of transducer 102 is coupled to a second terminal of resistor 202 and to a drain terminal of MOSFET 206. The negative terminal 217 of transducer 103 is coupled to a second terminal of resistor 203 and to a drain terminal of MOSFET 207. The negative terminal 219 of transducer 104 is coupled to a second terminal of resistor 204 and to the drain terminal of MOSFET 208. The negative terminal 221 of transducer 105 is coupled to a second terminal of resistor 205 and to the drain terminal of MOSFET 209.

Alternatively, the driver circuitry may be implemented using other switching devices, such as bipolar junction transistors (BJTs), junction field-effect transistors (JFETs), etc. Also, non-polarized transducers may be used in place of transducers having positive and negative terminals.

In accordance with at least one embodiment, the positive supply voltage at node 224 is coupled to a first terminal of power switch 223. A second terminal of power switch 223 is coupled to an input 225 of a voltage regulator 222. Voltage regulator 222 is coupled to the negative supply voltage at node 226. Voltage regulator 222 provides a regulated supply voltage at node 228 to microcontroller 201. Alternatively, the power switch 223 and/or the voltage regulator 222 may be omitted if, for example, a power-down mode is implemented in microcontroller 201 and/or a supply voltage compatible with microcontroller 201 is otherwise provided. Microcontroller 201 is coupled to the negative supply voltage at node 227.

Figure 3:
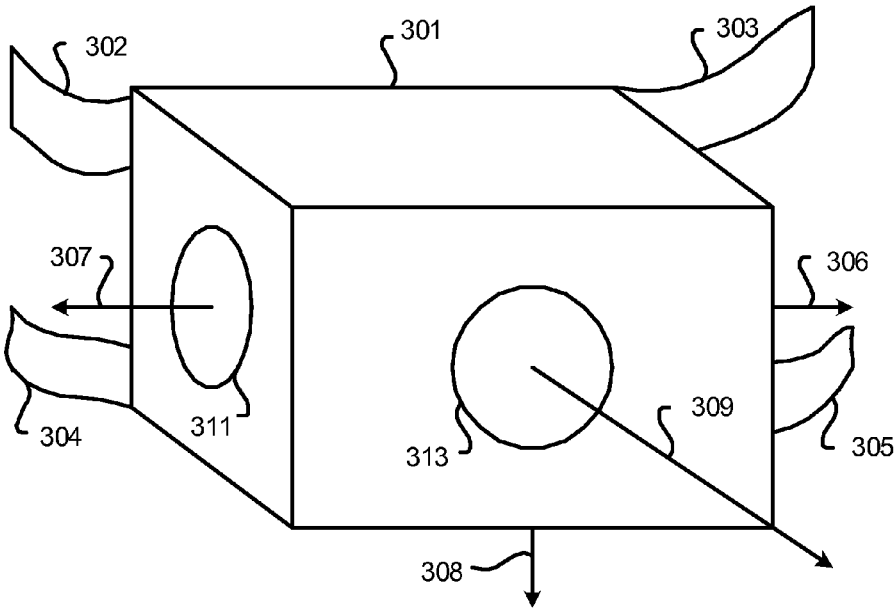
FIG. 3 is a perspective view diagram illustrating at least one embodiment of apparatus for enhancing spatial perception.

FIG. 3 is a perspective view diagram illustrating at least one embodiment of apparatus for enhancing spatial perception. In accordance with at least one embodiment, the apparatus comprises an enclosure 301 and one or more straps 302, 303, 304, and 305, which are attached to a rear surface of enclosure 301, for example, such that at least one strap extends in a leftward direction from the rear of enclosure 301 and at least another strap extends in a rightward direction from the rear of enclosure 301. In the exemplary configuration depicted, strap 302 extends in a rightward direction (as viewed from the rear) from an upper right rear corner of enclosure 301, strap 303 extends in a leftward direction from an upper left rear corner of enclosure 301, strap 304 extends in a rightward direction from a lower right rear corner of enclosure 301, and strap 305 extends in a leftward direction from a lower left rear corner of enclosure 301. As an example, straps 302, 303, 304, and 305 may have buckles, snaps, hook-and-loop mating surfaces, etc. to interconnect them. For example, strap 302 may have one or more of such features to interconnect it to strap 303, and strap 304 may have one or more of such features to interconnect it to strap 305. Accordingly, the straps may be wrapped around a user and used to secure enclosure 301 to the user, for example, in front of the user's abdomen.

Enclosure 301 is fitted with a plurality of transducers, such as transducers 311 and 313, with transducer 311 propagating a pressure wave along axis 307 and transducer 313 propagating a pressure wave along axis 309. Other transducers (not visible in FIG. 3) propagate pressure waves along axes 306 and 308.

Figure 4:
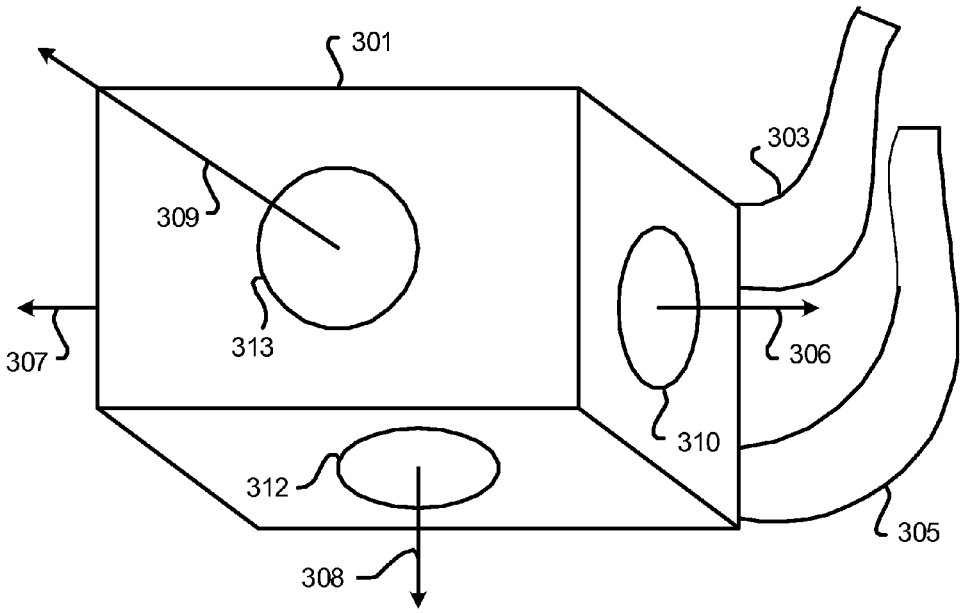
FIG. 4 is a perspective view diagram illustrating at least one embodiment of apparatus for enhancing spatial perception.

FIG. 4 is a perspective view diagram illustrating at least one embodiment of apparatus for enhancing spatial perception. Enclosure 301 is fitted with a plurality of transducers, such as transducers 310, 312, and 313, with transducer 310 propagating a pressure wave along axis 306, transducer 312 propagating a pressure wave along axis 308, and transducer 313 propagating a pressure wave along axis 309. At least one other transducer (not visible in FIG. 4) propagates a pressure wave along axis 307.

In accordance with at least one embodiment, at least one transducer (e.g., transducer 310) is oriented such that axis 306 is directed left of center, at least one transducer (e.g., transducer 311) is oriented such that axis 307 is directed right of center, at least one transducer (e.g., transducer 312) is oriented such that axis 308 is directed in a generally downward direction, and at least one transducer (e.g., transducer 313) is oriented such that axis 309 is directed in a generally forward direction. Alternatively, a subset or superset of such transducers may be directed along a plurality of directions angularly offset from one another. In accordance with at least one embodiment, each axis is separated from other axes by one or more angles of at least 45 degrees. Alternatively, each axis is separated from other axes by one or more angles of at least 60 degrees. Alternatively, each axis is separated from other axes by one or more angles of approximately 90 degrees.

While transducers are described as propagating a pressure wave along an axis, it should be understood that the propagation is typically not confined to a purely axial propagation, but conforms to a propagation pattern having a main lobe occurring in the direction of the axis. In accordance with at least one embodiment, transducers having propagation patterns that are broad enough to cover space between propagation patterns of other transducers yet narrow enough to maintain directional sensitivity in psychoacoustic response.

Figure 5:
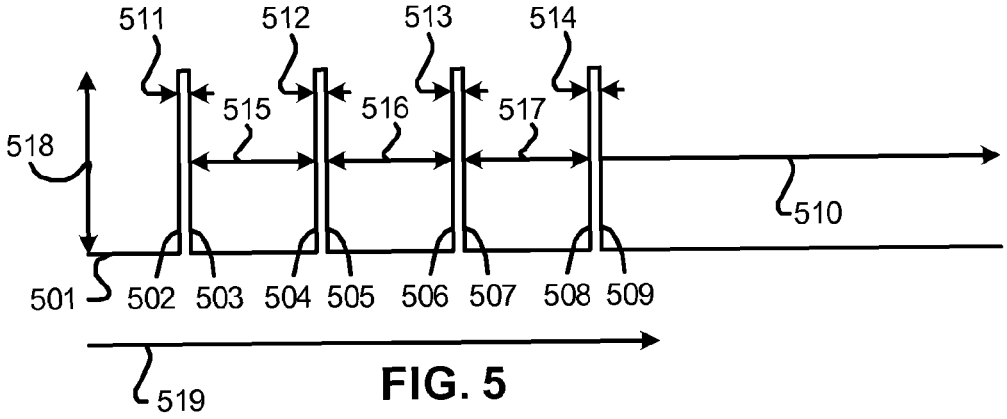
FIG. 5 is a timing diagram illustrating a sequence for initiating a plurality of pressure waves in accordance with at least one embodiment.

FIG. 5 is a timing diagram illustrating a sequence for initiating a plurality of pressure waves in accordance with at least one embodiment. The sequence comprises a plurality of excitation events for exciting transducers to produce pressure waves along their respective axes. For example, at time 502, a first excitation event of duration 511 occurs for a first transducer (e.g., transducer 310), abruptly increasing an amplitude from baseline 501 to a peak amplitude 518. As time progresses along time axis 519, the excitation event ends at time 503, returning the excitation signal to baseline 501. An inter-wave delay 515 occurs between time 503 and time 504. At time 504, a second excitation event of duration 512 occurs for a second transducer (e.g., transducer 311), abruptly increasing an amplitude from baseline 501 to a peak amplitude 518. At time 505, the excitation event ends, returning the excitation signal to baseline 501. An inter-wave delay 516 occurs between time 505 and time 506. At time 506, a third excitation event of duration 513 occurs for a third transducer (e.g., transducer 312), abruptly increasing an amplitude from baseline 501 to a peak amplitude 518. At time 507, the excitation event ends, returning the excitation signal to baseline 501. An inter-wave delay 517 occurs between time 507 and time 508. At time 508, a fourth excitation event of duration 514 occurs for a fourth transducer (e.g., transducer 313), abruptly increasing an amplitude from baseline 501 to a peak amplitude 518. At time 509, the excitation event ends, returning the excitation signal to baseline 501. Following completion of a last excitation event, the excitation signal remains at baseline 501 for a longer period 510, for some or all transducers.

Figure 6:
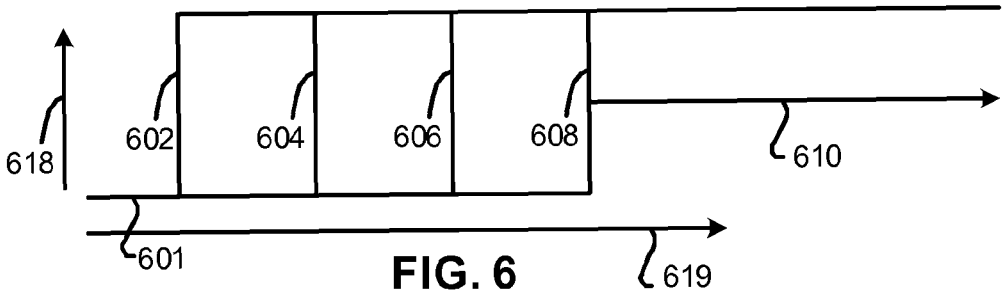
FIG. 6 is a timing diagram illustrating a sequence for initiating a plurality of pressure waves in accordance with at least one embodiment.

FIG. 6 is a timing diagram illustrating a sequence for initiating a plurality of pressure waves in accordance with at least one embodiment. The sequence comprises a plurality of excitation events for exciting transducers to produce pressure waves along their respective axes. For example, at time 602, a first excitation event occurs far a first transducer (e.g., transducer 310), abruptly increasing an amplitude from baseline 601 to a peak amplitude 618. As time progresses along time axis 619, a second excitation event occurs for a second transducer (e.g., transducer 311), abruptly increasing an amplitude from baseline 601 to a peak amplitude 618. At time 606, a third excitation event occurs for a third transducer (e.g., transducer 312), abruptly increasing an amplitude from baseline 601 to a peak amplitude 618. At time 608, a fourth excitation event occurs for a fourth transducer (e.g., transducer 313), abruptly increasing an amplitude from baseline 601 to a peak amplitude 618. Following completion of a last excitation event, the excitation signal remains at peak amplitude 618 for a longer period 610, for some or all transducers.

Figure 7:
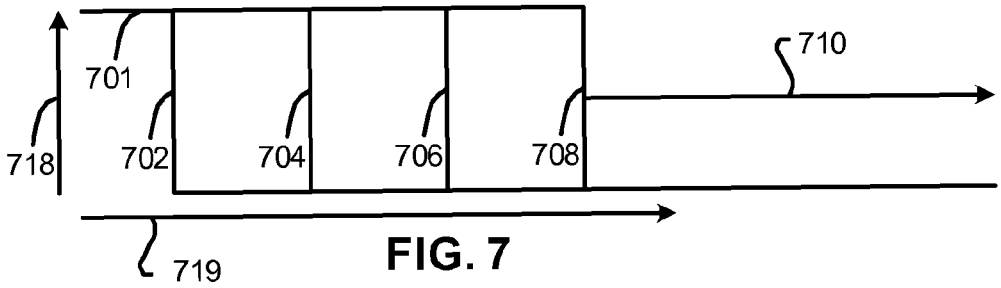
FIG. 7 is a timing diagram illustrating a sequence for initiating a plurality of pressure waves in accordance with at least one embodiment.

FIG. 7 is a timing diagram illustrating a sequence for initiating a plurality of pressure waves in accordance with at least one embodiment. The sequence comprises a plurality of excitation events for exciting transducers to produce pressure waves along their respective axes. For example, at time 702, a fifth excitation event occurs for a first transducer (e.g., transducer 310), abruptly decreasing an amplitude from peak amplitude 718 to a baseline 701. As time progresses along time axis 719, a sixth excitation event occurs for a second transducer (e.g., transducer 311), abruptly decreasing an amplitude from peak amplitude 718 to a baseline 701. At time 706, a seventh excitation event occurs for a third transducer (e.g., transducer 312), abruptly decreasing an amplitude from peak amplitude 718 to a baseline 701. At time 708, a fourth excitation event occurs for a fourth transducer (e.g., transducer 313), abruptly decreasing an amplitude from peak amplitude 718 to a baseline 701. Following completion of a last excitation event, the excitation signal remains at baseline 701 for a longer period 710, for some or all transducers.

In accordance with at least one embodiment, the sequences of FIG. 6 and FIG. 7 can be alternated to produce excitation events on both the rising and falling edges of the excitation signals for each transducer. Alternatively, one or more sequences in which one or more transducers are excited by a rising excitation signal and one or more transducers are excited by a falling excitation signal may be implemented.

Figure 8:
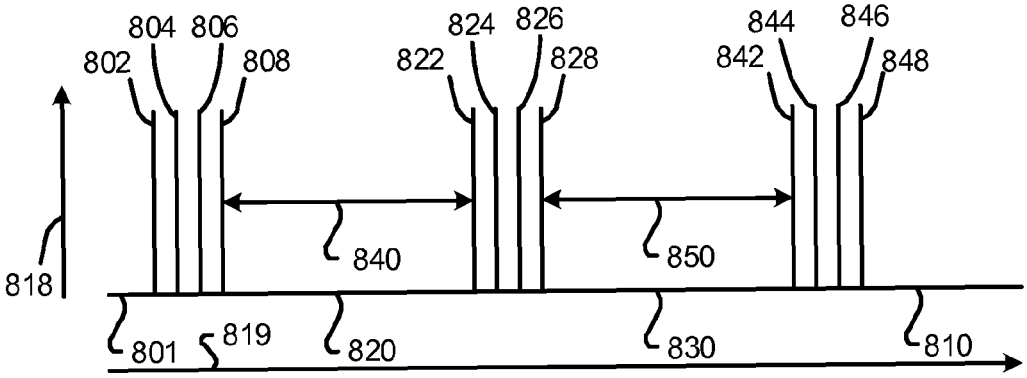
FIG. 8 is a timing diagram illustrating a sequence for initiating a plurality of pressure waves in accordance with at least one embodiment.

FIG. 8 is a timing diagram illustrating a sequence for initiating a plurality of pressure waves in accordance with at least one embodiment. If sequences, for example those depicted in FIG. 5, are viewed on a more compressed time scale, a plurality of such sequences can be seen to occur, which may be considered to form a longer, more complex sequence. The longer sequence comprises a first set of excitation events 802, 804, 806, and 808 for a respective set of transducers, a second set of excitation events 822, 824, 826, and 828 for the respective set of transducers, and a third set of excitation events 842, 844, 846, and 848 for the respective set of transducers. The longer sequence occurs as time progresses along time axis 819. Inter-wave delays occur between each of excitation events 802, 804, 806, and 808, between each of excitation events 822, 824, 826, and 828, as well as between each of excitation events 842, 844, 846, and 848. An inter-cycle delay 840 occurs between the first set of excitation events and the second set of excitation events. An inter-cycle delay 850 occurs between the second set of excitation events and the third set of excitation events. During each excitation event, a corresponding excitation signal rises from a baseline 801 to a peak amplitude 818 and/or falls from a peak amplitude 818 to a baseline 801, in accordance with at least one embodiment. As peak amplitude 818 represents a change in absolute amplitude, it should be understood that polarity of the signals can be reversed and/or a direct current (DC) offset can be provided, if desired.

As depicted in FIGS. 5-8, inter-wave delays and inter-cycle delays, as well as excitation pulse durations, can be selected to optimize performance in light of psychoacoustic response. For example, the excitation pulse duration can be adjusted to make an excitation pulse short enough so that the influence of inertia on the mass of the transducer is sufficient to prevent the transducer from generating a separate audibly distinct pressure wave based on excitation caused by the falling edge of the excitation pulse as well as the pressure wave generated based on excitation caused by the rising edge of the excitation pulse. Yet, the benefit of shortening the excitation pulse duration can be balanced against the benefit of lengthening the excitation pulse duration to make it sufficient to provide a maximum amount of power. For example, while driving a transducer with a very abrupt change in amplitude should produce an equally abrupt excitation of the transducer, non-idealities such as capacitances (e.g., capacitance of the transducer, other parasitic capacitances, etc.) can tend to filter the abrupt changes in amplitude, requiring somewhat longer pulses to achieve the maximum amplitude. Thus, in accordance with at least one embodiment, an excitation pulse width of between 1 and 200 microseconds is preferred. In accordance with at least one embodiment, an excitation pulse width of between 10 and 100 microseconds is preferred. In accordance with at least one embodiment, an excitation pulse width of between 25 and 60 microseconds is preferred.

To provide optimum excitation of transducers, both the amplitude and timing of excitation events can be controlled. Subject to the constraints of a transducer, greater amplitude can often be produced by exciting a transducer with a higher voltage excitation pulse. For example, an excitation pulse of at least 3 volts may be applied to the transducers. As another example, an excitation pulse of at least 5 volts may be applied to the transducers. As another example, an excitation pulse of at least 6 volts may be applied to the transducers. As another example, an excitation pulse of at least 9 volts may be applied to the transducers. As another example, an excitation pulse of at least 12 volts may be applied to the transducers. As another example, an excitation pulse of at least 18 volts may be applied to the transducers. As another example, an excitation pulse of at least 24 volts may be applied to the transducers. As yet another example, spark gap transducers may be used, and an excitation pulse of several thousand volts may be applied to the transducers with appropriate high voltage driver circuitry.

As another example, inter-wave delays can be selected to optimize performance in light of psychoacoustic response. The propagation velocity of the pressure waves generated by the transducers determines how much time it takes for the pressure waves to interact with objects in a user's surroundings and for audible products of those interactions to reach the user's ears. Accordingly, if inter-wave delays are selected to be too short, a subsequent pressure wave can impair the user's ability to hear those audible products. Thus, inter-wave delays should be sufficient to allow a pressure wave to travel to the farthest object within a desired range from the user and to allow the audible products resulting from the interaction of the pressure wave with the object to travel back to the user. On the other hand, selecting inter-wave delays that are unnecessarily long can slow down the rate at which pressure waves are generated, which can prevent pressure waves from being generated rapidly enough to provide the user with current information, which can be particularly problematic, for example, if the user and/or objects in the user's environment are moving and the user's relationship with surroundings is changing more rapidly than the audible products resulting from interaction of the pressure wave with objects in the surroundings are being received. Therefore, in accordance with at least one embodiment, inter-wave delays between 250 milliseconds and two seconds are preferred.

As yet another example, inter-cycle delays can be selected to optimize performance in light of psychoacoustic response. While an inter-cycle delay less than or equal to the inter-wave delay could be used, it can be beneficial to introduce an inter-cycle delay that is longer than the inter-wave delay. The longer inter-cycle delay can give the user's ears a rest and allow them to focus their attention on other ambient sounds that can be psychoacoustically processed to provide information that can be combined with information derived from the audible products resulting from interaction of the generated pressure waves with objects in the user's surroundings so as to yield a more complete understanding of the user's surroundings.

In accordance with at least one embodiment, a method for enhancing spatial perception is provided. The method comprises generating a first pressure wave propagating in a first direction, said first pressure wave adapted to interact with at least a first portion of a plurality of environmental objects and to produce a first response audible to a user. The method further comprises generating a second pressure wave propagating in a second direction. The second pressure wave is adapted to interact with at least a second portion of the plurality of environmental objects and to produce a second response audible to the user. The method further comprises causing additional iterations of the first and second pressure waves. In accordance with at least one embodiment, the method further comprises maintaining a similar sequence of the additional iterations of the first and second pressure waves.

In accordance with at least one embodiment, the first pressure wave is initiated with a first abrupt increase in amplitude and the second pressure wave is initiated with a second abrupt increase in amplitude. In accordance with at least one embodiment, a first inter-wave delay exists between the first abrupt increase in amplitude and the second abrupt increase in amplitude. A next iteration of the additional iterations of the first pressure wave occurs after an inter-cycle delay. In accordance with at least one embodiment, the inter-cycle delay is at least twice as long as the inter-wave delay. In accordance with at least one embodiment, the first inter-wave delay is between 250 milliseconds and two seconds.

In accordance with at least one embodiment, the first pressure wave is generated over a first wave generation time period and the second pressure wave is generated over a second wave generation time period. In accordance with at least one embodiment, the inter-wave delay is at least 20 times as long as the first wave generation time period and the inter-wave delay is at least 20 times as long as the second wave generation time period. In accordance with at least one embodiment, the first wave generation time period is less than 10 milliseconds and the second wave generation time period is less than 10 milliseconds.

In accordance with at least one embodiment, apparatus is provided comprising a first transducer having a first directional orientation, a second transducer having a second directional orientation; and a sequencer for initiating a first pressure wave at the first transducer and for initiating a second pressure wave at the second transducer. The first pressure wave is adapted to interact with at least a first portion of a plurality of environmental objects and to produce a first response perceptible to a user. The second pressure wave is adapted to interact with at least a second portion of the plurality of environmental objects and to produce a second response perceptible to the user. The sequencer causes additional iterations of the first and second pressure waves.

In accordance with at least one embodiment, the sequencer initiates the first pressure wave with a first abrupt increase in amplitude and the sequencer initiates the second pressure wave with a second abrupt increase in amplitude. In accordance with at least one embodiment, the sequencer causes a first inter-wave delay to occur between the first abrupt increase in amplitude and the second abrupt increase in amplitude. A next iteration of the additional iterations of the first pressure wave occurs after an inter-cycle delay. In accordance with at least one embodiment, the inter-cycle delay is at least twice as long as the inter-wave delay. In accordance with at least one embodiment, the first inter-wave delay is between 250 milliseconds and two seconds.

In accordance with at least one embodiment, the sequencer initiates the first pressure wave over a first wave generation time period and the sequencer initiates the second pressure wave over a second wave generation time period. In accordance with at least one embodiment, the inter-wave delay is at least 20 times as long as the first wave generation time period and the inter-wave delay is at least 20 times as long as the second wave generation time period. In accordance with at least one embodiment, the first wave generation time period is less than 10 milliseconds and the second wave generation time period is less than 10 milliseconds. In accordance with at least one embodiment, the sequencer maintains a similar sequence of the additional iterations of the first and second pressure waves.

In accordance with at least one embodiment, apparatus is provided comprising means for generating a first pressure wave propagating in a first direction, said first pressure wave adapted to interact with at least a first portion of a plurality of environmental objects and to produce a first response audible to a user; means for generating a second pressure wave propagating in a second direction, said second pressure wave adapted to interact with at least a second portion of the plurality of environmental objects and to produce a second response audible to the user; and means for causing additional iterations of the first and second pressure waves. In accordance with at least one embodiment, the means for generating the first pressure wave further comprises means for initiating the first pressure wave with a first abrupt increase in amplitude and wherein the means for generating the second pressure wave further comprises means for initiating the second pressure wave with a second abrupt increase in amplitude.

In accordance with at least one embodiment, a first inter-wave delay exists between the first abrupt increase in amplitude and the second abrupt increase in amplitude, wherein the means for causing additional iterations of the first and second pressure waves causes a next iteration of the additional iterations of the first pressure wave occurs after an inter-cycle delay. In accordance with at least one embodiment, the inter-cycle delay is at least twice as long as the inter-wave delay. In accordance with at least one embodiment, the first inter-wave delay is between 250 milliseconds and two seconds.

In accordance with at least one embodiment, the means for generating the first pressure wave causes the first pressure wave to be generated over a first wave generation time period and the means for generating the second pressure wave causes the second pressure wave to be generated over a second wave generation time period. In accordance with at least one embodiment, the inter-wave delay is at least 20 times as long as the first wave generation time period and the inter-wave delay is at least 20 times as long as the second wave generation time period. In accordance with at least one embodiment, the first wave generation time period is less than 10 milliseconds and the second wave generation time period is less than 10 milliseconds.

In accordance with at least one embodiment, the following is an exemplary computer program listing, compatible with at least an Atmel ATtiny13V microcontroller:

```
.device      ATtiny13
.set tccr0b = 0x33
.set tcnt0 = 0x32
.set tifr0 = 0x38
.set timsk0 = 0x39
```

-continued

```
.set mcucr = 0x35
.set portb = 0x18
.set ddrb = 0x17
.set i = 7
intv:     rjmp init              ; reset handler
          rjmp init              ; irq0 handler
          rjmp init              ; pin change handler
          rjmp t0oth             ; timer0 overflow handler
          rjmp init              ; eeprom ready handler
          rjmp init              ; analog comparator handler
init:     ldi r16,0b00000001     ; initialize r16 for use as a ring counter
          clc                    ; clear carry bit
          ldi r25,0b00001111     ; prepare to set pb4 as input, pb3..pb0 as
          out ddrb,r25           ; write ddrb
long:     ldi r25,0b00000101     ; prepare to set timer prescaler to ck/1024
          out tccr0b,r25         ; select timer prescaler of ck/1024
          clr r25                ; prepare to clear timer
          out tcnt0,r25          ; clear timer
          in r25,tifr0           ; read tifr0
          andi r25,0b00000010    ; clear tov0 flag
          out tifr0, r25         ; write tifr0
          in r25,timsk0          ; read timsk0
          ori r25,0b00000010     ; set toie0 bit
          out timsk0,r25         ; write timsk0
          bset i                 ; set i-bit in status reg
wait:     ldi r25,0b00100000     ; prepare to set se bit in mcucr
          out mcucr,r25          ; sleep enable
          sleep                  ; sleep until timer overflow interrupt
          sleep                  ; sleep another 512 * ck/1024
rise:     mov r18,r16            ; copy r16 to r18
          andi r18,0b00001111    ; mask out non-output bits
          ori r18,0b00010000     ; set pb4 pull-up resistor
          out portb,r18          ; drive output pins from ring counter
pulse:    ldi r25,0b00000001     ; prepare to set timer prescaler to ck/1024
          out tccr0b,r25         ; select timer prescaler of ck/1024
          ldi r25,0b11100000     ; prepare to preset timer
          out tcnt0,r25          ; preset timer
          ldi r25,0b00100000     ; prepare to set se bit in mcucr
          out mcucr,r25          ; sleep enable
          sleep                  ; sleep until timer overflow interrupt
fall:     ldi r25,0b00010000     ; prepare to stop driving all output pins
          out portb,r25          ; stop driving all output pins
rotrc:    rol r16                ; rotate r16 left through carry bit
          rjmp long              ; go back
t0oth:    in r25,tifr0           ; read tifr0
          andi r25,0b00000010    ; clear tov0 flag
          out tifr0, r25         ; write tifr0
          reti                   ; return from interrupt
```

What is claimed is:

1. A method comprising:

generating at a first transducer coupled to a sequencer a first pressure wave propagating in a first direction, said first pressure wave generated in response to a first excitation pulse having a first excitation pulse duration that can be selected to be long enough to provide a maximum amount of power and that can be selected to be short enough to provide less than a maximum amount of power, said first pressure wave adapted to interact with at least a first portion of a plurality of environmental objects and to be transformed into a first response audible to a user;

generating at a second transducer coupled to the sequencer a second pressure wave propagating in a second direction, said second pressure wave generated in response to a second excitation pulse having a second excitation pulse duration that can be selected to be long enough to provide a maximum amount of power and that can be selected to be short enough to provide less than a maximum amount of power, said second pressure wave adapted to interact with at least a second portion of the plurality of environmental objects and to be transformed into a second response audible to the user; and causing additional iterations of the first and second pressure waves.

2. The method of claim 1 wherein the first pressure wave is initiated with a first abrupt increase in amplitude and the second pressure wave is initiated with a second abrupt increase in amplitude.

3. The method of claim 2 wherein a first inter-wave delay exists between the first abrupt increase in amplitude and the second abrupt increase in amplitude, and wherein a next iteration of the additional iterations of the first pressure wave occurs after an inter-cycle delay, wherein the inter-cycle delay is at least twice as long as the inter-wave delay.

4. The method of claim 3 wherein the first inter-wave delay is between 250 milliseconds and two seconds.

5. The method of claim 3 wherein the first pressure wave is generated over a first wave generation time period and the second pressure wave is generated over a second wave generation time period, wherein the inter-wave delay is at least 20 times as long as the first wave generation time period and the inter-wave delay is at least 20 times as long as the second wave generation time period.

6. The method of claim 5 wherein the first wave generation time period is less than 10 milliseconds and the second wave generation time period is less than 10 milliseconds.

7. The method of claim 1 wherein the step of repeating further comprises:

maintaining a similar sequence of the additional iterations of the first and second pressure waves.

8. Apparatus comprising:

a first transducer having a first directional orientation;

a second transducer having a second directional orientation; and a sequencer for initiating a first pressure wave at the first transducer and for initiating a second pressure wave at the second transducer, wherein an inter-wave delay between said first pressure wave and said second pressure wave can be selected to optimize performance in light of a psychoacoustic response, said first pressure wave adapted to interact with at least a first portion of a plurality of environmental objects and to produce a first response perceptible to a user, and said second pressure wave adapted to interact with at least a second portion of the plurality of environmental objects and to produce a second response perceptible to the user, wherein an inter-cycle delay preceding additional iterations of the first pressure wave can be selected to optimize performance in light of the psychoacoustic response.

9. The apparatus of claim 8 wherein the sequencer initiates the first pressure wave with a first abrupt increase in amplitude and the sequencer initiates the second pressure wave with a second abrupt increase in amplitude.

10. The apparatus of claim 9 wherein the sequencer causes a first inter-wave delay to occur between the first abrupt increase in amplitude and the second abrupt increase in amplitude, wherein a next iteration of the additional iterations of the first pressure wave occurs after an inter-cycle delay, wherein the inter-cycle delay is at least twice as long as the inter-wave delay.

11. The apparatus of claim 10 wherein the first inter-wave delay is between 250 milliseconds and two seconds.

12. The apparatus of claim 10 wherein the sequencer initiates the first pressure wave over a first wave generation time period and the sequencer initiates the second pressure wave over a second wave generation time period, wherein the inter-wave delay is at least 20 times as long as the first wave generation time period and the inter-wave delay is at least 20 times as long as the second wave generation time period.

13. The apparatus of claim 12 wherein the first wave generation time period is less than 10 milliseconds and the second wave generation time period is less than 10 milliseconds.

14. The apparatus of claim 8 wherein the sequencer maintains a similar sequence of the additional iterations of the first and second pressure waves.

15. Apparatus comprising:

means for generating a first pressure wave propagating in a first direction, said first pressure wave adapted to interact with at least a first portion of a plurality of environmental objects and to produce a first response audible to a user;

means for generating a second pressure wave propagating in a second direction, said second pressure wave adapted to interact with at least a second portion of the plurality of environmental objects and to produce a second response audible to the user;

an enclosure enclosing said means for generating the first pressure wave, said means for generating the second pressure wave; and at least one strap attached to the enclosure, the at least one strap adapted to be wrapped around a user and used to secure the enclosure to the user.

16. The apparatus of claim 15 wherein the means for generating the first pressure wave further comprises means for initiating the first pressure wave with a first abrupt increase in amplitude and wherein the means for generating the second pressure wave further comprises means for initiating the second pressure wave with a second abrupt increase in amplitude.

17. The apparatus of claim 16 wherein a first inter-wave delay exists between the first abrupt increase in amplitude and the second abrupt increase in amplitude, wherein a means for causing additional iterations of the first and second pressure waves causes a next iteration of the additional iterations of the first pressure wave occurs after an inter-cycle delay, wherein the inter-cycle delay is at least twice as long as the inter-wave delay.

18. The apparatus of claim 17 wherein the first inter-wave delay is between 250 milliseconds and two seconds.

19. The apparatus of claim 17 wherein the means for generating the first pressure wave causes the first pressure wave to be generated over a first wave generation time period and the means for generating the second pressure wave causes the second pressure wave to be generated over a second wave generation time period, wherein the inter-wave delay is at least 20 times as long as the first wave generation time period and the inter-wave delay is at least 20 times as long as the second wave generation time period.

20. The apparatus of claim 19 wherein the first wave generation time period is less than 10 milliseconds and the second wave generation time period is less than 10 milliseconds.

* * * * *